US006154962A

United States Patent [19]

Ilkhanov

[11] Patent Number: 6,154,962

[45] Date of Patent: Dec. 5, 2000

[54] HEAD HAVING ELLIPTICAL BLADES FOR AN ELECTRIC SHAVER

[76] Inventor: Yashar Ilkhanov, 716 Ocean Pkwy., Apt. 2-H, Brooklyn, N.Y. 11230

[21] Appl. No.: 09/129,439

[22] Filed: Aug. 5, 1998

[51] Int. Cl.[7] ..... B26B 19/06

[52] U.S. Cl. ..... 30/34.1; 30/43.91; 30/43.6

[58] Field of Search ..... 30/43.91, 43.6, 30/34.1, 43.5

[56] References Cited

U.S. PATENT DOCUMENTS

| | | | |
|---|---|---|---|
| 4,350,059 | 9/1982 | Ainoura | 76/101 A |
| 5,014,428 | 5/1991 | Yamashita | 30/43.6 |
| 5,427,001 | 6/1995 | Uchiyama et al. | 76/115 |

*Primary Examiner*—Kenneth E. Peterson
*Attorney, Agent, or Firm*—Richard L. Miller

[57] ABSTRACT

A head for attachment to the body of the electric shaver. The head comprises a guard comb that attaches to the body of the electric shaver, a rotary shaft that extends axially in the guard comb, a plurality of blades that are individual, parallels inclined, and extend in, and to, the guard comb. The plurality of blades have centers through which the rotary shaft extends for rotation therewith, and when rotated by the rotary shaft, the plurality of blades traverse an elliptical path, in a sweeping back and forth motion, by virtue of their incline. The head further includes a sliding trimmer that is slidably mounted in an axial slot in the guard comb, and is operatively connected to a periphery of a blade for axial sweeping back and forth motion as the blade rotate, by virtue of their incline. The sliding trimmer includes a trimmer blade that is slidably mounted on the axial slot in the guard comb and a pair of spaced-apart followers that depend from the trimmer blade, through the axial slot, and straddlably engage the blade for sweeping back and forth movement relative thereto, by virtue of their incline. The guard comb of the head is either semi-cylindrically-shaped with a straight, a convexed, or a concaved axial contour, or has an axial contour comprising a plurality of convexed-semi-circular-shaped portions, with the plurality of blades having shapes and sizes to match the specific contour of the specific guard comb.

1 Claim, 2 Drawing Sheets

FIG. 1
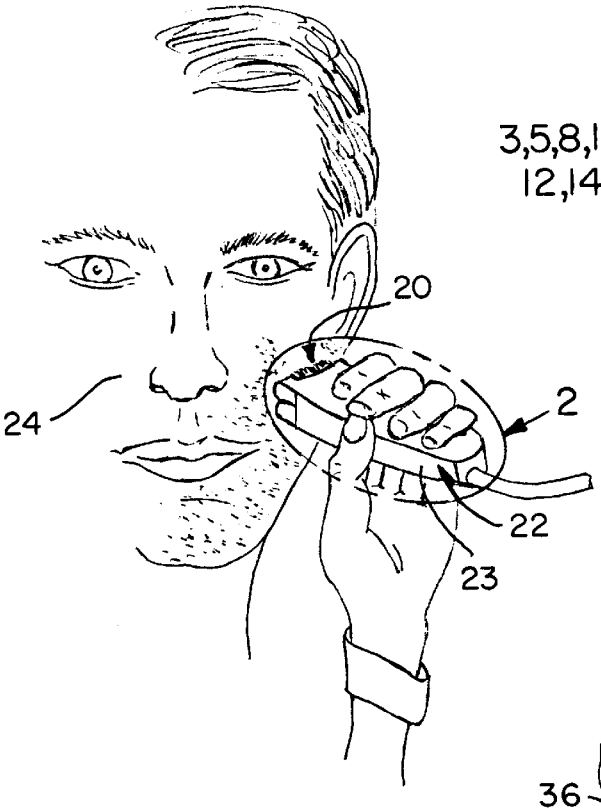
FIG. 2
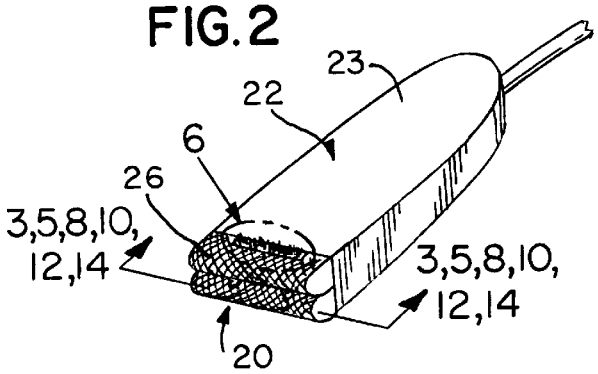
FIG. 4
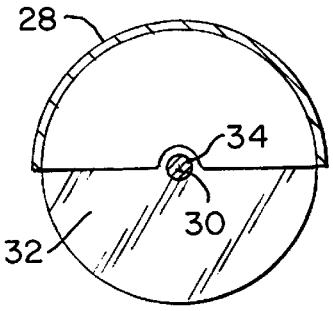
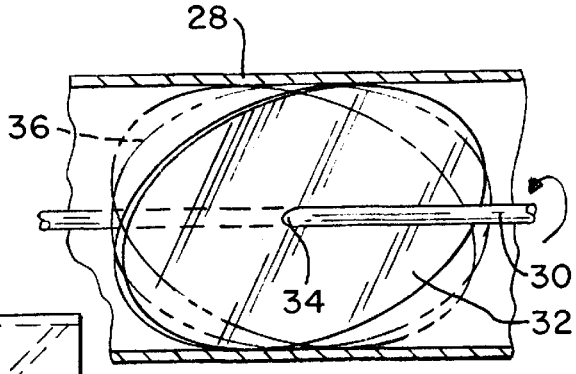
FIG. 5
FIG. 3
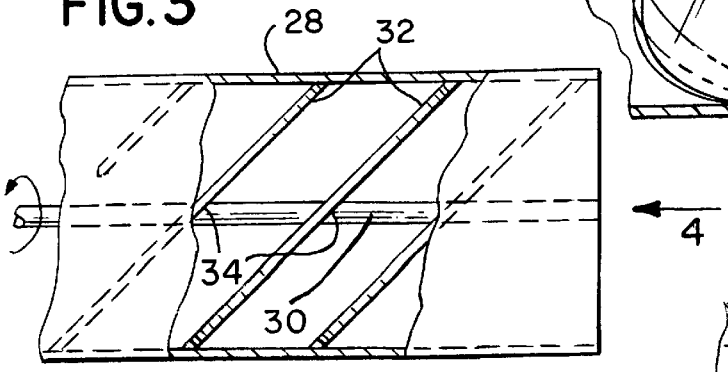
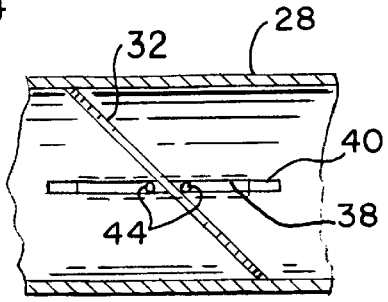
FIG. 7

FIG.6
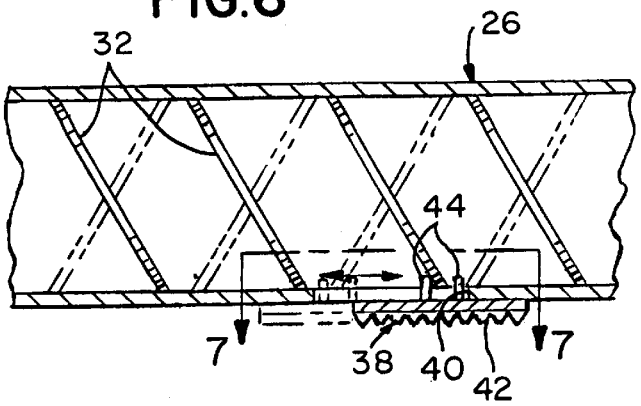
FIG.9
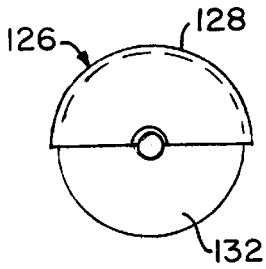
FIG.11
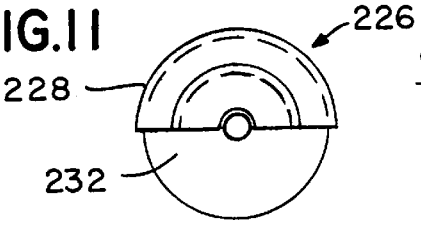
FIG.8
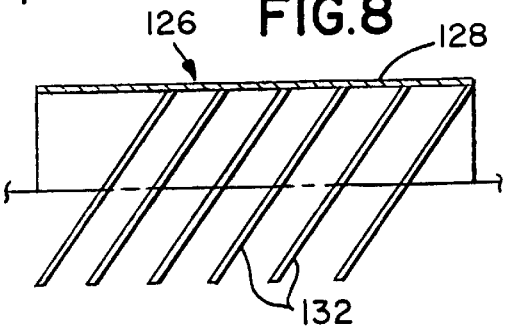
FIG.10
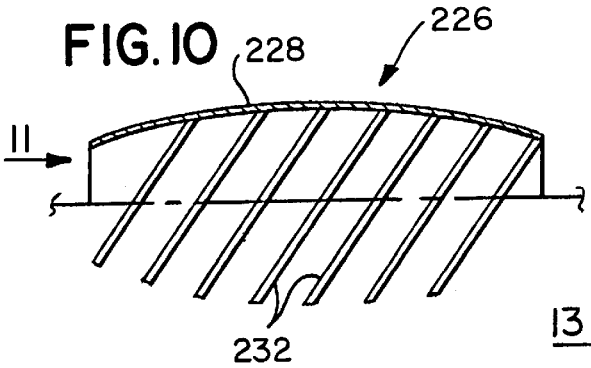
FIG.13
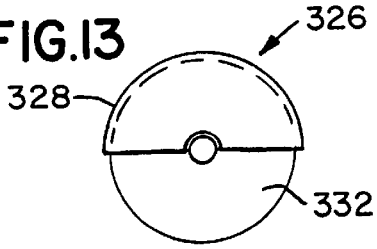
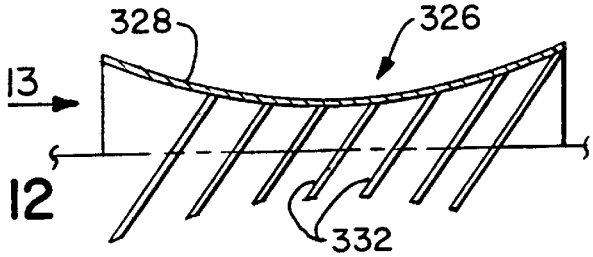
FIG. 12
FIG.15
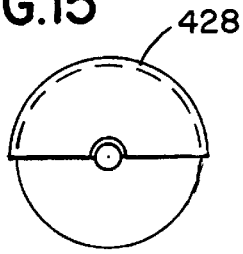
FIG.14
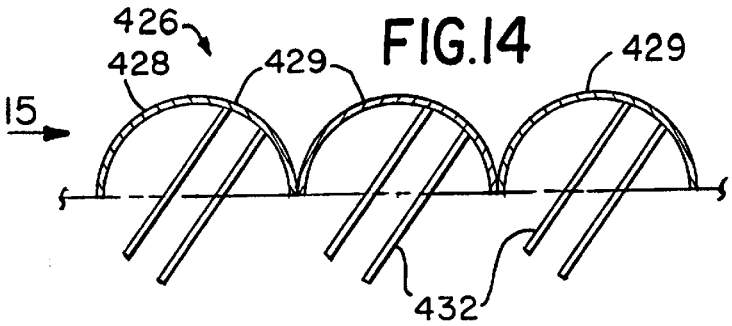

HEAD HAVING ELLIPTICAL BLADES FOR AN ELECTRIC SHAVER

BACKGROUND OF THE INVENTION

1. Field of the Invention

The present invention relates to a head for an electric shaver. More particularly, the present invention relates to a head having inclined blades for an electric shaver.

2. Description of the Prior Art

Numerous innovations for electric razor related devices have beer, provided in the prior art that will be described. Even thouqh these innovations may be suitable for the specific individual purposes to which they address, however, they differ from the present invention.

A FIRST EXAMPLE, U.S. Pat. No. 4,350,059 to Ainoura teaches a screw type shaving cutter and a method of producing the same large number of cutting edges are formed on the flanks of the thread of the cutter. Each cutting edge is inclined along a carve or a straight line in the trailing direction as viewed in the direction of rotation of the cutter in use. This shaving cutter is produced by forming a screw body by cutting a metal blanks into a form of a screw, and forming a number of cutting edges on the flanks of the thread of the screw body by reciprocatingly moving a cutting tool on the flanks of the thread, while rotating the screw body continuously in one direction.

A SECOND EXAMPLE, U.S. Pat. No. 5,014,428 to Yamashita teaches a rotary type electric razor which includes an arch-shaped external cutting edge detachably mounted on an upper side of a main body case, an internal cutting edge driving unit supported for free vertical movement with respect to the main body case, and a motor speed detecting means provided within the main body case. The internal cutting edge driving unit comprises a rotary internal cutting edge which rotates in sliding contact with respect to the internal face of the external cutting edge, an internal cutting edge driving chassis for rotatively supporting the rotary internal cutting edge, a motor mounted on the internal cutting edge driving chassis, and a drive transmitting means for transmitting the output of the motor to the rotary internal cutting edge. The motor speed detecting means comprises a rotary member mounted to the output shaft of the motor, and a photo-sensor opposite the rotary member.

A THIRD EXAMPLE, U.S. Pat. No. 5,427,001 to Uchiyama et al. teaches a method and apparatus for opening slits of uneven lengths in the concentric circular shaving sections of an external cutting member that is used in an electric razor using a rotary cutter that cuts the shaving sections of the external cutting member in radial directions as the external cutting member is rotated around its axis by a predetermined angle with a use of an index device. The differences in the length of the slit are obtained by changing the cutting edge of the rotary cutter relative to the external cutting member.

It is apparent that numerous innovations for electric shaver related devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a head having inclined blades for an electric shaver that avoids the disadvantages of the prior art.

ANOTHER OBJECT of the present invention is to provide a head having inclined blades for an electric shaver having inclined blades that is simple and inexpensive to manufacture.

STILL ANOTHER OBJECT of the present invention is to provide a head having inclined blades for an electric shaver that is simple to use.

BRIEFLY STATED, YET ANOTHER OBJECT of the present invention is to provide a head for attachment to the body of the electric shaver. The head comprises a guard comb that attaches to the body of the electric shaver, a rotary shaft that extends axially in the guard comb, a plurality of blades that are individual, parallel, inclined, and extend in, and to, the guard comb. The plurality of blades have centers through which the rotary shaft extends for rotation therewith, and when rotated by the rotary shaft, the plurality of blades traverse an elliptical path, in a sweeping back and forth motion, by virtue of their incline. The head further includes a sliding trimmer that is slidably mounted in an axial slot in the guard comb, and is operatively connected to a periphery of a blade for axial sweeping back and forth motion as the blade rotate, by virtue of its incline. The sliding trimmer includes a trimmer blade that is slidably mounted on the axial slot in the guard comb and a pair of spaced-apart followers that depend from the trimmer blade, through the axial slot,, and both straddlably engage the blade for sweeping back and forth movement relative thereto, by virtue of its incline. The guard comb of the head is either semi-cylindrically-shaped with a straight, a convexed, or a concaved axial contour, or has an axial contour comprising a plurality of convexed-semi-circular-shaped portions, with the plurality of blades having shapes and sizes to match the specific contour of the specific guard comb.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures on the drawing are briefly described as follows:

FIG. 1 is a diagrammatic perspective view of a man utilizing an electric shaver with the present invention;

FIG. 2 is an enlarged diagrammatic perspective view of the area generally enclosed by the dotted ellipse identified by arrow 2 in FIG. 1 of the general configuration of the present invention utilized as a part of an electric shaver;

FIG. 3 is an enlarged cross sectional view taken on line 3—3 in FIG. 2 with the inclined blades not rotating;

FIG. 4 is a diagrammatic end elevational view taken generally in the direction of arrow 4 in FIG. 3;

FIG. 5 is an enlarged cross sectional view taken on line 5—5 in FIG. 2 with an inclined blade rotating and traversing an elliptical path;

FIG. 6 is an enlarged cross sectional view of the area generally enclosed by the dotted ellipse identified by arrow 6 in FIG. 2 of the slider trimmer;

FIG. 7 is an enlarged cross sectional view taken on line 7—7 in FIG. 6;

FIG. 8 is an enlarged cross sectional view taken on line 8—8 in FIG. 2 of the specific configuration of a first embodiment of the present invention;

FIG. 9 is a diagrammatic end elevational view taken generally in the direction of arrow 9 in FIG. 8;

FIG. 10 is an enlarged cross sectional view taken on line 10—10 in FIG. 2 of the specific configuration of a second embodiment of the present invention;

FIG. 11 is a diagrammatic end elevational view taken generally in the direction of arrow 11 in FIG. 10;

FIG. 12 is an enlarged cross sectional view taken on line 12—12 in FIG. 2 of the specific configuration of a third embodiment of the present invention;

FIG. 13 is a diagrammatic end elevational view taken generally in the direction of arrow 13 in FIG. 12;

FIG. 14 is an enlarged cross sectional view taken on line 14—14 in FIG. 2 of the specific configuration of a fourth embodiment of the present invention; and FIG. 15 is a diagrammatic end elevational view taken generally in the direction of arrow 15 in FIG. 14.

LIST OF REFERENCE NUMERALS UTILIZED IN THE DRAWING

General Configuration

20 head having inclined blades for an electric shaver of the present invention
22 electric shaver
23 body of electric shaver 22
24 man
26 head for attachment to body 23 of electric shaver 22
28 guard comb of head 26 for attaching to body 23 of electric shaver 22 and protecting man 24 being shaved
30 rotary shaft in head 26
32 plurality of blades in head 26
34 centers of plurality of blades 32 in head 26
36 elliptical path traversed by plurality of blades 32 in head 26
38 sliding trimmer of head 26 for axial sweeping back and forth motion as blade of plurality of blades 32 in head 26 rotate
40 axial slot in guard comb 28 of head 26
42 trimmer blade of sliding trimmer 38 of head 26
44 pair of spaced-apart followers of sliding trimmer 38 of head 26

Specific Configuration of First Embodiment

126 head
128 guard comb of head 126
132 plurality of blades in head 126

Specific Configuration of Second Embodiment

226 head
228 guard comb of head 226
232 plurality of blades in head 226

Specific Configuration of Third Embodiment

326 head
328 guard comb of head 326
332 plurality of blades in head 326

Specific Configuration of Fourth Embodiment

426 head
428 guard comb of head 426
429 plurality of convexed-semi-circular-shaped portions comprising guard comb 428 of head 426
432 plurality of blades in head 426

DESCRIPTION OF THE PREFERRED EMBODIMENT

Referring now to the figures, in which like numerals indicate like parts, and particularly to FIG. 1, the head having inclined blades for an electric shaver of the present invention is shown generally at 20 for an electric shaver 22 having a body 23 and shaving a man 24.

The general configuration of the head having inclined blades for an electric shaver 20 can best be seen in FIG. 2, and as such will be discussed with reference thereto.

The head having inclined blades for an electric shaver 20 comprises a head 26 for attachment to the body 23 of the electric shaver 22.

The general configuration of the head 26 can best be seen in FIGS. 3–7, and as such will be discussed with reference thereto.

The head 26 comprises a guard comb 28 that is elongated, and is for attaching to the body 23 of the electric shaver 22 and protecting the man 24 being shaved.

The head 26 further comprises a rotary shaft 30 that extends axially in the guard comb 28 of the head 26.

The head 26 further comprises a plurality of blades 32 that are individual and separate from each other, parallel, inclined, and extend in, and to, the guard comb 28 of the head 26.

The plurality of blades 32 in the head 26 have centers 34 through which the rotary shaft 30 in the head 26 extends for rotation therewith, and when rotated by the rotary shaft 30 in the head 26, the plurality of blades 32 in the head 26 traverse an elliptical path 36, in a sweeping back and forth motion, by virtue of their incline.

The head 26 further comprises a sliding trimmer 38 that is slidably mounted in an axial slot 40 in the guard comb 28 of the head 26, and is operatively connected to a periphery of a blade of the plurality of blades 32 in the head 26 for axial sweeping back and forth motion as the blade of the plurality of blades 32 in the head 26 rotate, by virtue of their incline.

The sliding trimmer 38 of the head 26 comprises a trimmer blade 42 that is slidably mounted on the axial slot 40 in the guard comb 28 of the head 26.

The sliding trimmer 38 of the head 26 further comprises a pair of spaced-apart followers 44 that depend from the trimmer blade 42 of the sliding trimmer 38 of the head 26, through the axial slot 40 in the guard comb 28 of the head 26, and straddlably engage the blade of the plurality of blades 32 in the head for sweeping back and forth movement relative thereto, by virtue of their incline.

The specific configuration of a first embodiment of a head 126 can best be seen in FIGS. 8 and 9, and as such will be discussed with reference thereto.

The head 126 comprises a guard comb 128 which is semi-cylindrically-shaped, with a straight axial contour.

The head 126 further comprises a plurality of blades 132 that are all of the same shape and size and match the straight axial. contour of the guard comb 128 of the head 126.

The specific configuration of a second embodiment of a head 226 can best be seen in FIGS. 10 and 11, and as such will be discussed with reference thereto.

The head 226 comprises a guard comb 228 which is semi-cylindrically-shaped, with a convexed axial contour.

The head 226 further comprises a plurality of blades 232 that are all not of the same shape and size and match the convexed axial contour of the guard comb 228 of the head 226.

The specific configuration of a third embodiment of a head 326 can best be seen in FIGS. 12 and 13, and as such will be discussed with reference thereto.

The head 326 comprises a guard comb 328 which is semi-cylindrically-shaped, with a concaved axial contour.

The head 326 further comprises a plurality of blades 332 that are all not of the same shape and size and match the concaved axial contour of the guard comb 328 of the head 326.

The specific configuration of a fourth embodiment of a head 426 can best be seen in FIGS. 14 and 15, and as such will be discussed with reference thereto.

The head 426 comprises a guard comb 428 which has an axial contour comprising a plurality of convexed-semi-circular-shaped portions 429.

The head 426 further comprises a plurality of blades 432 that are all not of the same shape and size and match the axial contour comprising the plurality of convexed-semi-circular-shaped portions 429 of guard comb 428 of the head 426.

It will be understood that each of the elements described above, or two or more together, may also find a useful application in other types of constructions differing from the types described above.

While the invention has been illustrated and described as embodied in a head for an electric shaver having inclined elliptical blades, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A cutting attachment for an electric shaver having a body, comprising a head for attachment to the body of the electric shaver, wherein said head comprises;

a) a guard comb being elongated and for attaching to the body of the electric shaver and protecting the man being shaved, wherein said head further comprises;

b) a rotary shaft extending axially in said guard comb of said head; and c) a plurality of blades being individual and separate from each other, parallel, inclined, and extending in, and to, said guard comb of said head; each said blade being one-piece, completely planar, and elliptically-shaped, wherein said head further comprises a sliding trimmer that is slidably mounted in an axial slot in said guard comb of said head, and is operatively connected to a periphery of a blade of said plurality of blades in said head for axial sweeping back and forth motion as said blade of said plurality of blades in said head rotates, by virtue of its incline, wherein said sliding trimmer of said head comprises a trimmer blade that is slidably mounted on said axial slot in said guard comb of said head, wherein said sliding trimmer of said head further comprises a pair of spaced-apart followers that depend from said trimmer blade of said sliding trimmer of said head, through said axial slot in said guard comb of said head, and both engage said blade of said plurality of blades in said head for sweeping back and forth movement relative thereto, by virtue of its incline.

* * * * *